US011046503B2

(12) United States Patent
Bruder et al.

(10) Patent No.: US 11,046,503 B2
(45) Date of Patent: Jun. 29, 2021

(54) LIQUID DISPENSER FOR DISPENSING A LIQUID, HAVING AN ADDITIONAL RESERVOIR FOR AN ADDITIONAL MEDIUM

(71) Applicant: Aptar Radolfzell GmbH, Radolfzell (DE)

(72) Inventors: Thomas Bruder, Constance (DE); Frédéric Duquet, Crespières (FR)

(73) Assignee: APTAR RADOLFZELL GMBH, Radolfzell (DE)

( * ) Notice: Subject to any disclaimer, the term of this patent is extended or adjusted under 35 U.S.C. 154(b) by 0 days.

(21) Appl. No.: 16/637,410

(22) PCT Filed: Jul. 31, 2018

(86) PCT No.: PCT/EP2018/070740
§ 371 (c)(1),
(2) Date: Feb. 7, 2020

(87) PCT Pub. No.: WO2019/030055
PCT Pub. Date: Feb. 14, 2019

(65) Prior Publication Data

US 2020/0180849 A1 Jun. 11, 2020

(30) Foreign Application Priority Data

Aug. 9, 2017 (EP) ..... 17185629

(51) Int. Cl.
*B65D 83/68* (2006.01)
*B05B 11/00* (2006.01)

(52) U.S. Cl.
CPC ..... *B65D 83/685* (2013.01); *B05B 11/0054* (2013.01); *B05B 11/0078* (2013.01)

(58) Field of Classification Search
CPC ... B65D 83/685; B65D 83/14; B05B 11/0054; B05B 11/0078; B05B 11/0041; B05B 7/2482
See application file for complete search history.

(56) References Cited

U.S. PATENT DOCUMENTS 3,258,171 A * 6/1966 Reich ..... B65D 83/72 222/146.3
3,338,479 A * 8/1967 Marraffino ..... B65D 83/685 222/635

(Continued)

FOREIGN PATENT DOCUMENTS

| | | | |
|---|---|---|---|
| DE | 102011078476 | A1 | 1/2013 |
| EP | 1166885 | A1 | 1/2002 |
| JP | H02160068 | A | 6/1990 |

OTHER PUBLICATIONS

European Search Report issued in corresponding EP 17 18 5629 with English translation of categories of cited documents, dated Feb. 12, 2018 (8 pages).

(Continued)

*Primary Examiner* — Vishal Pancholi
(74) *Attorney, Agent, or Firm* — Flynn Thiel, P.C.

(57) ABSTRACT

Dispensers having a liquid reservoir filled with a main liquid and having a dispensing head, with a dispensing opening and a dispensing channel, which connects the reservoir outlet to the dispensing opening. The dispensing head can be pressed down to actuate the switching valve or the conveying device. The liquid dispenser has a replaceable exchange unit, which, in a functional state, forms the dispensing channel at least in some sections. The exchange unit has a mixing chamber, with an addition medium and an inlet and an outlet separated from the inlet. The exchange unit is part of the dispensing channel such that the inlet is communicatively connected to the reservoir outlet and the outlet is communicatively con- (Continued)

nected to the dispensing opening. Furthermore, the exchange unit has closures at the inlet and at the outlet to close the mixing chamber.

16 Claims, 7 Drawing Sheets

(56) References Cited

U.S. PATENT DOCUMENTS

| | | | | |
|---|---|---|---|---|
| 3,593,894 | A | 7/1971 | Kehoe et al. | |
| 5,906,316 | A * | 5/1999 | Gatzemeyer | B05B 1/3442 239/10 |
| 6,622,890 | B2 | 9/2003 | Gueret | |
| 8,444,017 | B2 * | 5/2013 | Chiba | B05B 11/3014 222/137 |
| 2004/0060945 | A1 * | 4/2004 | Cater | B05B 7/0031 222/1 |
| 2017/0014843 | A1 | 1/2017 | Richman et al. | |

OTHER PUBLICATIONS

International Search Report issued in corresponding International Application No. PCT/EP2018/070740 with English translation dated Nov. 22, 2018 (6 pages).

Written Opinion of International Searching Authority issued in corresponding International Application No. PCT/EP2018/070740 dated Nov. 22, 2018 (5 pages).

* cited by examiner

LIQUID DISPENSER FOR DISPENSING A LIQUID, HAVING AN ADDITIONAL RESERVOIR FOR AN ADDITIONAL MEDIUM

APPLICATION FIELD AND PRIOR ART

The invention relates to a liquid dispenser which has a liquid reservoir with a main liquid and has an additional medium which is mixed with the main liquid in the course of dispensing the liquid.

A corresponding demand exists if the main liquid and the additional medium as two components may be mixed only directly before being dispensed, because the action of the mixed liquid would be reduced if the additional medium were provided already mixed with the main liquid. Above all, however, there arises a corresponding demand if the additional medium should allow the possibility of dispensing an individual mixture on the basis of the same main liquid, that is to say, with the same liquid dispenser, the possibility of producing and dispensing optionally different mixtures with the addition of different additional media.

U.S. Pat. No. 3,593,894 A discloses a dispenser which has a mixing chamber which can be screwed on for the purpose of introducing an additional medium.

JP H02-160068 A discloses a dispensing head into which an additional medium of tablet form type is inserted in order to deliver an additional medium to a liquid as the latter flows through.

EP 1166885 A1 discloses a dispensing head which has a receiving space into which an additional medium of tablet form type can be inserted.

OBJECT AND ACHIEVEMENT

The object of the invention is to develop a liquid dispenser of the type in question to the effect that an additional medium can be admixed with the main liquid in a convenient and hygienically satisfactory manner and the possibility is provided of also using optionally different additional media.

What is proposed according to the invention for this purpose is a liquid dispenser which has a liquid reservoir filled with a main liquid, wherein the liquid reservoir is designed either as a pressure reservoir and has a switching valve by means of which the main liquid can be conveyed from the liquid reservoir to a reservoir outlet, or is designed as a pressureless liquid reservoir and has a conveying device by means of which the main liquid can be conveyed from the liquid reservoir to a reservoir outlet.

In order to dispense liquid, the liquid dispenser has a dispensing head which has a dispensing opening. A dispensing duct connects the dispenser outlet of the liquid reservoir, that is to say a duct portion of the liquid reservoir beyond the switching valve or the conveying device, to the dispensing opening.

The dispensing head can be pressed down to actuate the switching valve or the conveying device. As a result, main liquid is discharged at the reservoir outlet of the liquid reservoir and flows into the dispensing duct of the outlet head up to its dispensing opening, from where the discharge takes place.

According to the invention, the liquid dispenser has an interchangeable exchange unit which, in a functional state, forms the dispensing duct at least in certain portions. This exchange unit comprises a mixing chamber in which an additional medium is arranged. The mixing chamber is as intended traversed by the flow of the main liquid during a dispensing operation, which liquid here flows via an inlet into the mixing chamber, is mixed in the mixing chamber with the pulverulent, solid or liquid additional medium and flows out of the mixing chamber again through the outlet separated from the inlet. The mixing chamber is thus arranged in the dispensing duct in such a way that the inlet is communicatively connected with the reservoir outlet, and the outlet is communicatively connected with the dispensing opening.

In a storage state prior to use by the end user, the exchange unit has closures at the inlet and at the outlet by means of which the mixing chamber is closed in a fluid-tight manner in a storage state. These closures are opened as intended in the course of the preparation or use of the liquid dispenser. Until then, however, they isolate, the additional medium in the mixing chamber on the inlet and outlet sides of the mixing chamber with respect to the surroundings, with the result that neither a leakage or the like nor a short-term impairment of the medium by contact with surrounding air has to be feared.

With the exception of said inlet and outlet, the mixing chamber of the exchange unit is not accessible without destruction. Filling or refilling by the end customer is not intended. In particular, apart from the inlet and the outlet, the mixing chamber is delimited by walls which are formed in one piece with one another.

The liquid reservoir with the switching valve or the conveying device and also the reservoir outlet of the liquid reservoir are intended for multiple use with a plurality of exchange units, with the result that the liquid volume of the main liquid is at least double the volume of the additional medium or in particular the additional liquid in the mixing chamber. The volume is preferably between 100 ml and 500 ml.

Many different designs are possible to the effect that some constituent parts, apart from the liquid reservoir, are part of the reusable unit intended for multiple use and some are part of the exchange unit. A distinction that should be drawn in principle between designs in which the dispensing head as a whole forms the exchange unit and those in which the dispensing head is configured as a reusable constituent part of the dispenser and designed for coupling to interchangeable exchange units.

In a first preferred embodiment, the reservoir outlet is designed as an outlet connector. The exchange unit is intended for coupling thereto, for which purpose it is designed as a complete dispensing head and has a coupling connection which is designed for coupling to the outlet connector. A communicative connection with the inlet of the mixing chamber is created as a result.

Accordingly, in such a configuration, the exchange unit is designed in such a way that it comprises the entire dispensing duct from the coupling connection to the dispensing opening, with the mixing chamber being provided between the coupling connection and dispensing opening. In such a configuration, the two closures assigned to the outlet and the inlet of the mixing chamber can be provided directly on the dispensing opening and on the coupling connection, with the result that the dispensing duct as a whole forms the isolated mixing chamber.

In the configuration described, the entire dispensing head is exchanged as an exchange unit. In the storage state, before the mounting on the reservoir outlet, the closures are closed. Before or during the mounting on the reservoir outlet, the inlet-side closure is preferably opened. In the course thereof, or upon first actuation, the outlet-side closure is then likewise opened.

A very high degree of hygiene is ensured as a result of the complete exchange of the dispensing head, since all fluid-conducting parts which conduct the mixture of main liquid and additional medium are exchanged. In addition, the mounting of a dispensing head forming the exchange unit is very simple and intuitive, since all that is required is a mere placement of the dispensing head.

In alternative configurations, the dispensing head is provided in principle for reuse and is, if required, connected to an exchange unit. In some such variants, such a dispensing head has a receiving space which is designed for receiving the exchange unit. A feed duct portion of the dispensing duct, which forms a part of the dispensing head, opens into this receiving space. The exchange unit is designed in such a way that, upon insertion into the receiving space, it assumes a desired position in which the mouth of the feed duct portion comes into communicative connection with the inlet of the mixing chamber of the exchange unit.

Accordingly, the main liquid flows from the reservoir outlet into a feed duct portion of the dispensing duct which opens into the receiving space of the dispensing head. The exchange unit is positioned therein and secured in a force-fitting or form-fitting manner. The feed duct portion bears flush at the inlet or an inlet duct such that the liquid does not pass into an intermediate region between walls of the receiving space and outer walls of the exchange unit and the latter thus remains clean for reusability.

The receiving space preferably has an opening element which is arranged and designed so as to be adapted to the exchange unit in such a way that, by introducing the exchange unit into the receiving space or by closing a closing element which closes the receiving space, the closure at the inlet of the mixing chamber or the closure at the outlet of the mixing chamber is destructively opened.

Such an opening element comes, in the course of insertion, into mechanical contact with one of the closures and opens said closure as a result. The opening element is preferably designed to be pointed or with a sharp edge such that it can as it were puncture or cut the closure. The opening element is preferably produced from plastic, but can also be of metallic design.

As will be described in more detail below, the closure can be in particular a thin-walled surface portion which is injection-molded directly on the housing of the exchange unit or can be a separate thin-walled and/or film-like surface portion.

The receiving space can be configured as a receiving space which completely isolates the exchange unit from view. In such a configuration, there can be provision in particular that the dispensing head has a closing element which delimits the receiving space and which is movable between a closed position and an open position with respect to a basic component of the dispensing head.

Alternatively, the receiving space can be designed as a receiving shaft which is open at least on one side from an outer side of the dispensing head and into which the exchange unit can be inserted in an insertion direction. For this purpose, the reusable part of the dispensing head requires no relatively movable part such as the aforementioned closing element. For insertion purposes, the shaft can be oriented counter to the dispensing direction of the dispensing opening, in particular in a configuration in which the dispensing opening is provided on the exchange unit. Alternatively, for insertion of the exchange unit, the shaft can be formed in the dispensing direction, with it being the case, in a particular configuration, that the shaft can be formed as a continuous shaft in which the insertion of the exchange unit is provided in the dispensing direction. The exchange unit can then project through the shaft and directly have the dispensing opening.

The insertion direction is preferably oriented nonparallel to the actuating direction such that an inadvertent actuation during insertion is improbable. An angle of approximately 90°, in particular between 75° and 105°, is preferred.

In another possible configuration, there is provision that the liquid dispenser has a dispensing head which has an outer connection piece for coupling the exchange unit.

In such a configuration, the exchange unit is accordingly mounted on the outer side of the dispensing head provided for reuse, thereby making mounting very straightforward. The exchange unit and the connection piece are preferably configured to interact in a force-fitting or latching manner, with the result that the exchange unit can be snapped onto the housing of the dispensing head against a slight resistance and can be removed after use.

It is particularly advantageous if the connection piece itself is designed for use as a dispensing opening and it is additionally provided that the exchange unit has a dispensing opening which is communicatively connected with the outlet of the mixing chamber in the exchange unit. This configuration allows the dispensing head to be used with and without an exchange unit. If an exchange unit is fastened to the connection piece, its dispensing opening forms the dispensing opening of the liquid dispenser. The liquid flows through the connection piece into the exchange unit, is mixed there with the additional medium and is then dispensed in mixed form through the dispensing opening. If no exchange unit is fastened to the connection piece, the unmixed main liquid is dispensed directly through the connection piece then acting as a dispensing opening.

Embodiments in which the dispensing opening is part of the exchange unit are also possible and expedient in other types of exchange units. What is common to such configurations is that the exchange of the exchange unit also leads to the exchange of all parts which have come into contact with the additional medium. Such a configuration is therefore particularly expedient for applications in which different types of additional medium are used as intended or customarily with the same liquid dispenser.

A further advantageous possibility for realizing the invention provides that the liquid dispenser has a dispensing head which has a coupling connector, facing the liquid reservoir, on the dispensing duct pointing in the direction of the liquid reservoir. The exchange unit likewise has a coupling connector which is designed for coupling to said coupling connector of the dispensing head, wherein the exchange unit-side coupling connector is communicatively connected with the outlet of the mixing chamber. Furthermore, the exchange unit has an inlet connector which is designed for communicative connection with the reservoir outlet of the liquid reservoir.

In such a configuration, there is provision that the exchange unit is inserted between the dispensing head, which is intended for reuse, and the liquid reservoir, wherein the outlet is connected to the coupling connector of the dispensing head and the inlet is connected to the reservoir outlet. For the purposes of replacement, the dispensing head is removed and then the used exchange unit is removed from the dispensing head or the reservoir outlet. A new exchange unit is then plugged onto the dispensing head or the liquid reservoir, and the dispensing head and the liquid reservoir are reassembled with the exchange unit arranged therebetween.

In a configuration of the liquid dispenser with a receiving space for receiving the exchange unit, a configuration is considered to be particularly advantageous in which the mixing chamber of the exchange unit is delimited at least partially and preferably, with respect to the area, for the most part by film walls. Such an exchange unit can be produced in a particularly favorable manner. The film wall can comprise a single plastic wall. Of advantage, however, is a combination of film layers which together ensure that the additional medium is stored in an aging-resistant manner. Depending on the type of the additional medium, different layers, possibly also metallic foil layers, can be expedient.

It is particularly advantageous if the exchange unit has a rigid portion. The exchange unit is then constructed as a type of composite unit from a flexible bag-like portion and a rigid portion which is adjoined by the flexible portion. The exchange unit and in particular its rigid portion are preferably adapted to the receiving space in such a way that the rigid portion can be fixed in a defined position at the receiving space in a form-fitting manner. This facilitates the insertion of the exchange unit and ensures a precise orientation as is required for the opening of the closure assigned to the inlet and/or outlet.

In a particularly advantageous variant, the rigid portion is penetrated on the inlet side or outlet side by the dispensing duct. The outlet duct on the inlet or outlet side is accordingly likewise precisely positioned by the positioning of the rigid portion in the receiving space, thus serving for the connection to dispensing head-side portions of the dispensing duct or the precise positioning of the dispensing opening as part of the rigid portion.

There are various possibilities for configuring the closures of the mixing chamber on the outlet and inlet side. Possible and preferred configurations here are in particular configurations in which a thin and preferably film- or membrane-like closure surface is provided which is either destroyed in the course of insertion of the exchange unit and the first actuation or removed.

Also possible, however, are closures in the manner of switching valves which are brought into a stable opening state upon being put into operation. Particularly preferred here is a configuration in which the exchange unit has two sub-units which can be displaced relative to one another once for the purpose of activation, wherein the closure at the inlet and/or at the outlet of the mixing chamber is designed as a sliding valve which is opened by the relative movement in the course of the activation. In order to transfer the valve, in particular said sliding valve, into an opening state, a pressure surface, by means of which the sub-units can be displaced relative to one another, is preferably provided on an outer side of the exchange unit, particularly preferably on an outer side of the exchange unit designed as a dispensing head. It is thus directly evident from the exchange unit whether it has already been used or is still unopened. The pressure surface can also correspond with an actuating surface of the dispensing head such that a uniform movement opens the exchange unit and initiates the dispensing operation.

A number of configurations are possible for said thin and preferably film- or membrane-like closure surfaces, with it being possible also to provide different types of closure surfaces and/or types of said switching valves for the inlet and the outlet.

Thus, the closure at the inlet and/or at the outlet of the mixing chamber can be configured with a peel-off film. Such a peel-off film usually has an adhesive side by means of which it is adhered to a surface breached by the dispensing duct on the inlet side or outlet side. The peel-off film preferably further has a free portion which does not stick to the surface and can therefore be easily gripped for the purpose of detaching the peel-off film.

Another form of such a closure is provided by a closure surface which, in the course of placing the exchange unit on the reservoir outlet or the connection piece, is destroyed by an opening element. In such a configuration, there is provision that the opening element, which is preferably configured to be at least partially sharp-edged, is arranged in the installed or attached state of the exchange unit at a point where previously the closure surface of the exchange unit was arranged. During the movement of the exchange unit into the intended position, the opening element therefore comes into contact with the closure surface and punctures, tears or breaks it.

A closure surface provided for destruction can preferably be formed with local weakenings in order to ensure defined bursting.

In a particular embodiment with an opening element in the receiving space, the receiving space and the exchange unit are designed in terms of their outer shape in such a way that, upon insertion of the exchange unit into the receiving space, an elastic stress is generated in walls of the receiving space and/or of the exchange unit and, upon continued insertion, is unloaded in such a way that the opening element is pressed against and destroys the closure surface as a result.

In such a configuration, there is accordingly provision that, as a result of the shaping of the exchange unit and receiving space, the insertion of the exchange unit leads to a provisional storage by elastic deformation which, toward the end of the insertion movement, supports the latter and thus ensures that the opening element strikes the closure surface with an increased force impact. Such a configuration is particularly also expedient when both a closure surface at the inlet and at the outlet is intended to be destroyed during the same insertion movement.

A further way for a closure surface, which delimits the mixing chamber of the exchange unit on the inlet or outlet side, provides that the closure surface is configured in such a way that it can be destructively opened by means of an opening pressure which is less than the pressure which can be generated by the pressure reservoir or by the conveying device. The pressure from the pressure reservoir or the conveying device is accordingly sufficient to destroy the closure surface as intended. Such a closure surface can therefore remain intact until first actuation of the liquid dispenser with a previously unused exchange unit. However, as soon as pressurized liquid from the liquid reservoir side presses against the closure surface, the latter is destroyed such that the liquid can pass through.

In the case of a pressure reservoir, the maximum liquid pressure depends solely on the structural design of the pressure reservoir and the pressure built up therein at the factory. In the case of a manually actuated conveying device in the manner of a pump, the maximum pressure is, where appropriate, dependent on the actuating force. In such a case, said closure surface is preferably designed such that it can be destroyed by pressing down the dispensing head with a constant 20 newtons, preferably with a constant 10 newtons.

The invention relates primarily in the described manner to a liquid dispenser of said type which comprises the reusable unit, comprising the liquid reservoir and, where appropriate, a reusable dispensing head, and an exchange unit having said closures, wherein the closures are still intact in the delivery state and are opened first by the end consumer.

Such a dispenser is preferably intended to be used successively with a plurality of structurally identical exchange units having the same or different additional media. The invention therefore also relates to a corresponding set, which comprises the liquid dispenser of the type described and at least one additional exchange unit, with the result that at least two structurally identical exchange units are part of the set.

To supplement a liquid dispenser already acquired previously, the exchange units can preferably also be acquired separately individually or multiply, with the result that the separate exchange units of the type described, individually or in sets of at least two exchange units, are also understood as part of the invention.

Preferred intended applications of a liquid dispenser according to the invention are in particular skin and hair care. For the field of skin care, it is considered to be advantageous if the main liquid in the liquid reservoir is a skin cream or lotion, in particular for face care. The exchange units can then be used to individualize the skin cream to suit the personal needs of the skin, for example with active ingredients which, in a targeted manner, treat different effects of skin aging, such as wrinkles, an uneven skin or enlarged skin pores. A similar purpose is served by the use of exchange units which are filled with a tanning medium in different quantities or with different effects in order, during a treatment with tanning cream, to achieve only a gentle change instead of a very short-term change. In the field of hair care products, the main liquid can be a shampoo, a conditioner or an intensive hair treatment which is individualized via the exchange units, for example with additional media for improving hair shine, for avoiding dandruff formation or for treating/calming the scalp.

BRIEF DESCRIPTION OF THE DRAWINGS

Further advantages and aspects of the invention will emerge from the claims and from the following description of preferred exemplary embodiments of the invention which are explained below with reference to the figures.

FIGS. 8AA, 8BB and 8CC are cross-sectional views of the dispensing head for the seventh liquid dispenser which respectively correspond to FIGS. 8A, 8B and 8C.

DETAILED DESCRIPTION OF THE EXEMPLARY EMBODIMENTS

Figure 1:
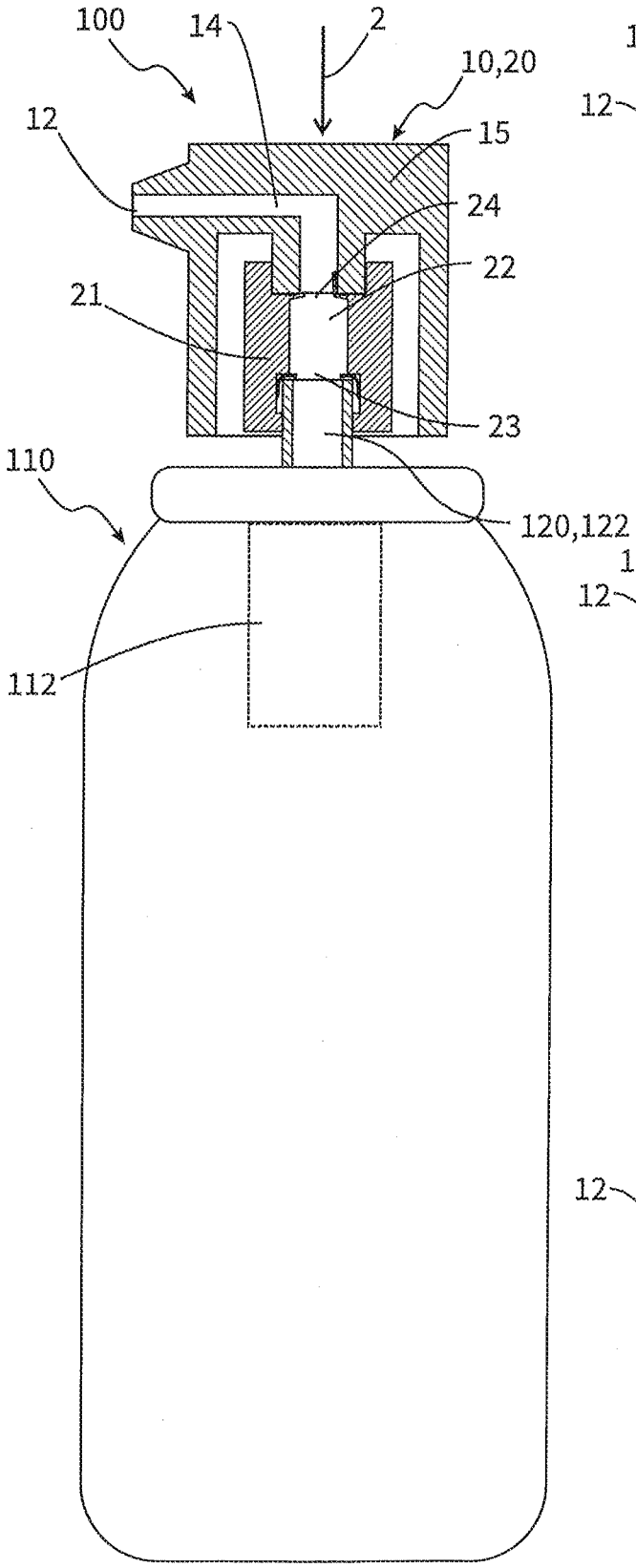
FIGS. 1 and 1A and 1B show a first liquid dispenser according to the invention and the steps for putting it into operation.
Figure 1A:
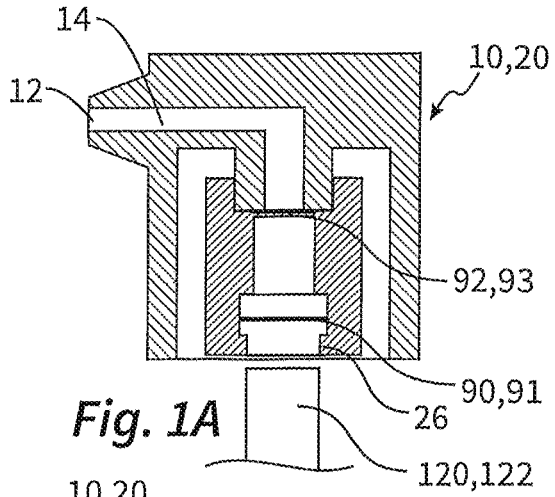
Figure 1B:
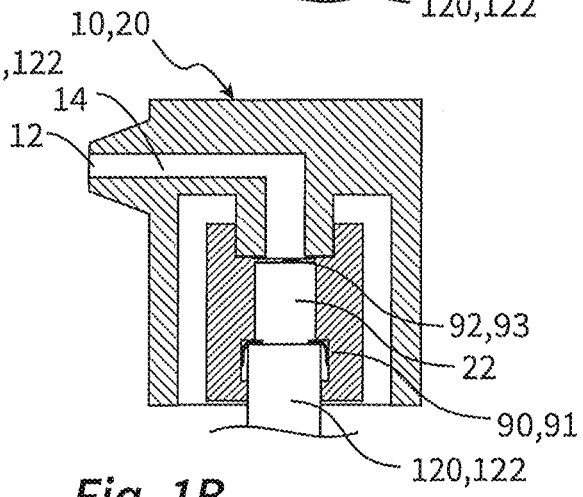

FIGS. 1 and 1A and 1B show a first exemplary embodiment of the invention. The liquid dispenser 100 according to the invention comprises a liquid reservoir 110 having a reservoir outlet 120. Pressing down the reservoir outlet 120 in the form of an outlet connector 122 in the direction of the arrow 2 makes it possible for a switching valve 112, which is merely indicated in FIG. 1, to be switched, with the result that the liquid, which was previously already under pressure, can be delivered through the reservoir outlet 120, which is designed as a hollow connector, out of the liquid reservoir 110 in the direction of a dispensing head 10.

In addition to a housing 15 and a dispensing opening 12, which penetrates through the housing 15, the dispensing head 10 comprises a sleeve-shaped component 21 which delimits a mixing chamber 22 and at which, with reference to FIG. 1A, in a delivery and storage state, there is provided, on both sides of the mixing chamber 22, in the region of an inlet 23 and an outlet 24, a respective closure 90, 92 having a closure surface 91, 93. At the lower end of the sleeve-shaped component 21, the latter has a coupling connection 26 which is designed for coupling to the outlet connector 122. The housing 15 and the sleeve-shaped component 21 are fixedly connected to one another and could also be formed in one piece.

There is provision as intended that, in a dispenser as shown in FIGS. 1 to 1B a main liquid or carrier liquid can be repeatedly discharged from the liquid reservoir 110 by pressing down the dispensing head 10. This liquid is as intended discharged together with an additional medium which, in the delivery and storage state of FIG. 1A, is situated in the mixing chamber 22. The dispensing head 10 as a whole constitutes an exchange unit 20, with different exchange units 20 having different additional media in the mixing chamber 22 customarily being held available. As intended, an actuation occurs after coupling the dispensing head 10, which forms an exchange unit 20, to the outlet connector 122, by means of which actuation the main liquid is conveyed from the liquid reservoir 110 in the direction of the dispensing duct 14 and toward the dispensing opening 12. Here, the liquid flows through the mixing chamber 22 and is mixed here with the additional medium previously stored therein.

Since the exchange units 20 in the form of the dispensing heads 10 are intended to maintain an isolation of the mixing chamber 22 and of the additional medium situated therein over a relatively long storage period, said closures 90, 92 are provided. The closure 90 provided on the inlet 23 side comprises a closure surface 91 which can be formed in one piece with the sleeve 21 or is incorporated as a separate component. As is evident by way of the transition from the state of FIG. 1A to the state of FIG. 1B, the placement of the dispensing head 10 on the outlet connector 122 leads as intended to the closure surface 91 being breached. This is illustrated in FIG. 1B.

The closure 92 having the closure surface 93 on the outlet 24 side of the mixing chamber 22 is, however, still intact at this time. However, as soon as the dispensing head 10 is pressed down in the direction of the arrow in the manner illustrated in FIG. 1, there occurs an over pressure in the mixing chamber 22 by which the closure surface 93 is destroyed, with the result that now the dispensing duct 14 with the mixing chamber 22 integrated therein provides for free dispensing. The fact that only the overpressure opens the mixing chamber on the outlet side promotes the mixing between the additional medium previously stored in the mixing chamber 22 and the main liquid, which flows via the inlet 23 into the mixing chamber 22.

Figure 2:
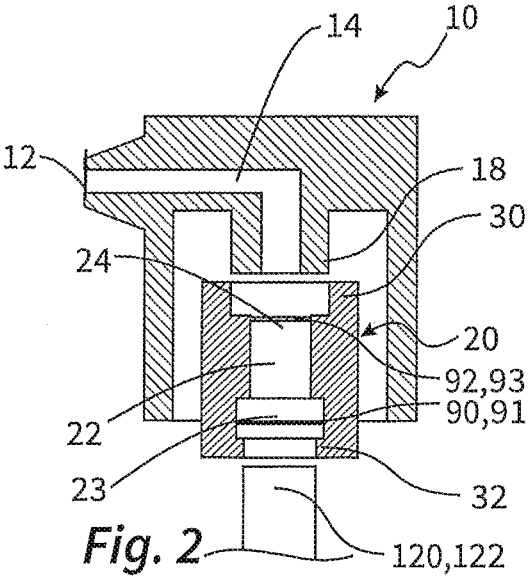
FIG. 2 shows a dispensing head for a second liquid dispenser according to the invention.

The exemplary embodiment of FIG. 2 differs from the exemplary embodiment of FIG. 1 in that the housing 15, as main constituent part of the dispensing head 10, is provided for reuse. In this exemplary embodiment, the exchange unit 20 is formed solely by the sleeve 21 and the mixing chamber 22 with inlet 23 and outlet 24, the mixing chamber surrounding said sleeve and being filled with additional medium.

Unlike in the exemplary embodiment of FIGS. 1 to 1B, for putting into operation, the exchange unit 20 is accordingly coupled in the region of a coupling connector 30 to a coupling connector 18 of the dispensing head 10 by plugging, and the combination of the dispensing head 10 or its housing 15 and the exchange unit 20 is coupled jointly to the outlet connector 122 with the use of an inlet connector 32. However, the manner of opening the closures 90, 92 at the inlet 23 and outlet 24 remains identical.

Figure 3:
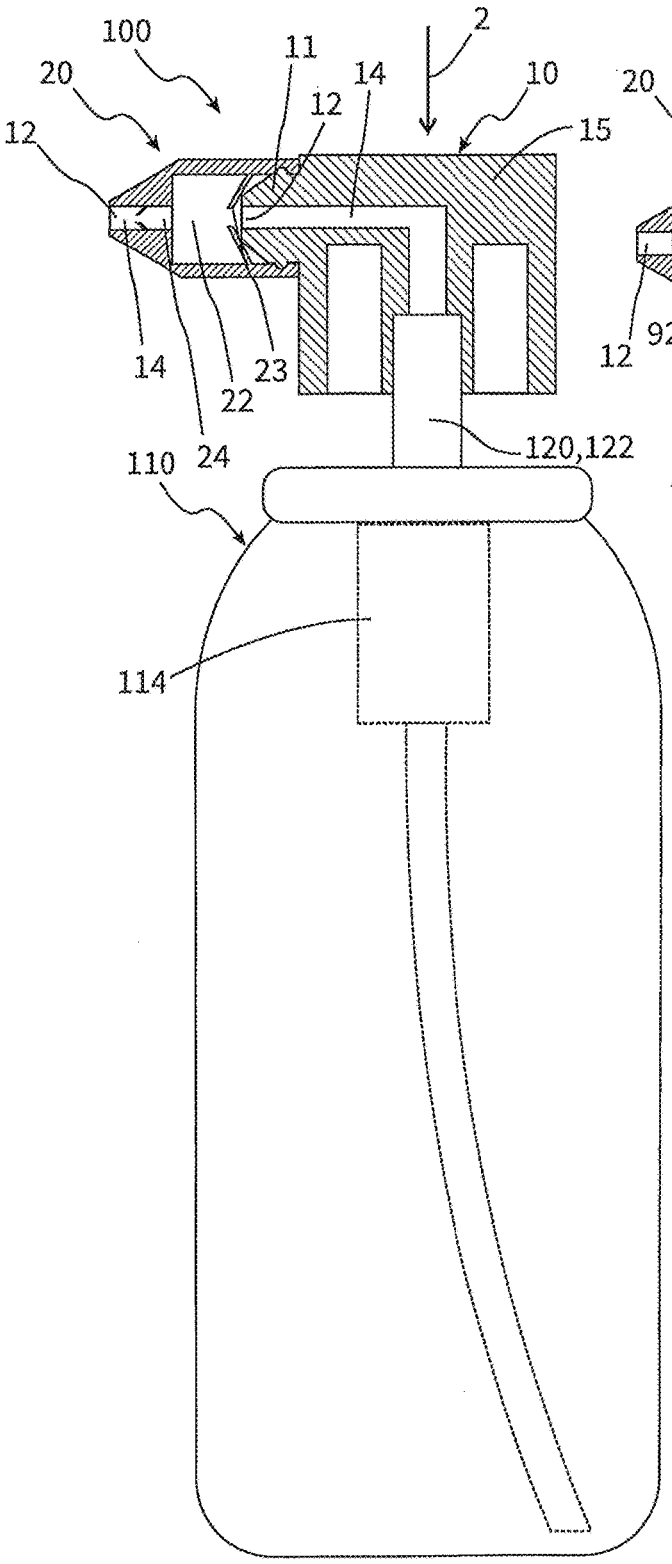
FIGS. 3 and 3A and 3B show a third liquid dispenser according to the invention and the steps for putting it into operation.

In the embodiment as shown in FIG. 3, there is provision, first of all by way of example as a difference, that the liquid reservoir 110 is not designed as a pressure reservoir, but instead as a pump reservoir having a schematically illustrated conveying device 114 in the manner of a pump which can be actuated by pressing down the dispensing head 10 in the actuating direction 2 and then conveys liquid from the liquid reservoir 110 to the reservoir outlet 120.

The dispensing head 10 in this embodiment has the particular feature that use can be made of a dispensing opening 12 provided on the housing 15 of the dispensing head without fastening an exchange unit 20 on the dispensing head 10.

Figure 3A:
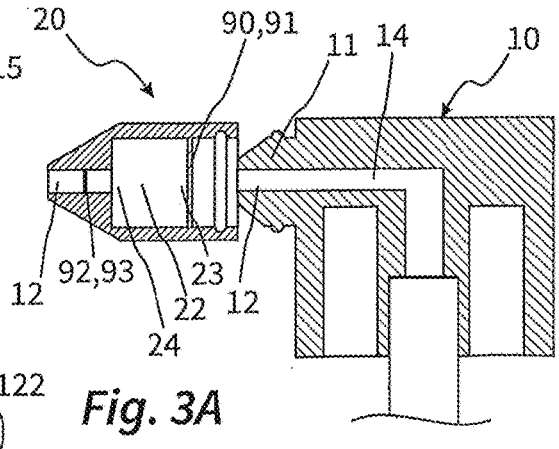
Figure 3B:
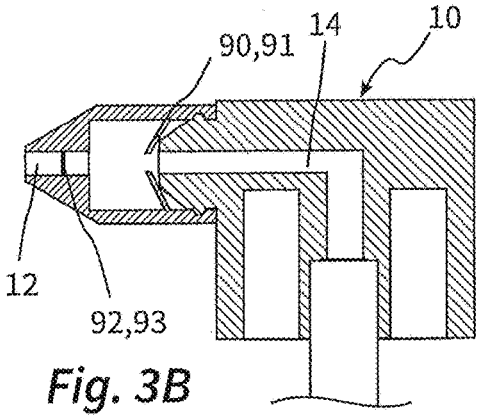

However, an exchange unit 20 can also be used. The latter is pushed from outside onto a connection portion 11 in the manner illustrated by FIGS. 3A and 3B where it is held by a latching connection. As can be seen from FIG. 3B, when pushing the exchange unit 20 onto the connection portion 11 the latter is inserted into the exchange unit 20 to such an extent that it opens the closure 90 at the inlet side 23 by destroying the closure surface 91. On the outlet 24 side, however, the closure 92 with the closure surface 93 remains first of all intact. In a corresponding manner to the preceding exemplary embodiment, there is provision here too, that the closure surface 93 at the closure 92 is destroyed only upon first actuation, since the conveying device 114 is designed to make available a sufficiently high pressure to allow opening when the dispensing head 10 is pressed down in the direction of the arrow 2 with at least 10 newtons of actuating force.

Figure 4:
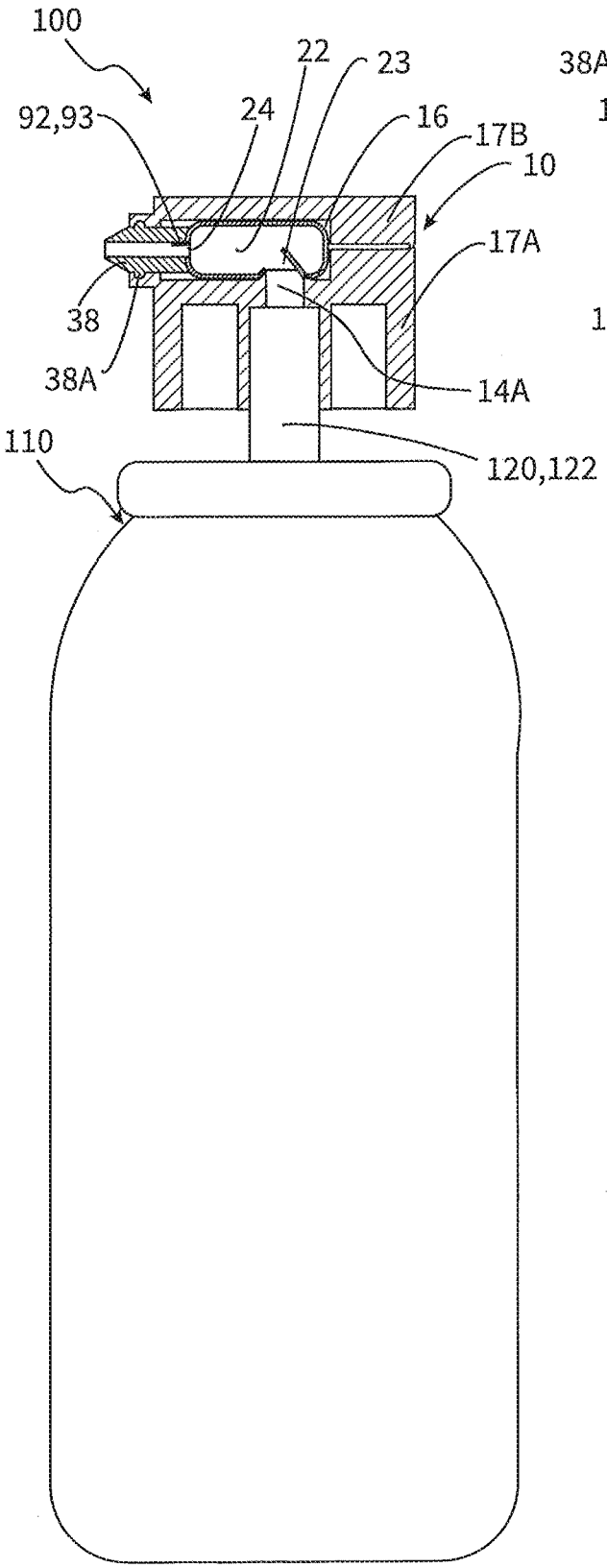
FIGS. 4 and 4A to 4C show a fourth liquid dispenser according to the invention and the steps for putting it into operation.

In the exemplary embodiment of FIG. 4, there is provision as a particular feature that the housing of the dispensing head has a base 17A and a closing element 17B which can be folded with respect to the latter about a film hinge, said base and closing element together delimiting a receiving space 16.

Figure 4A:
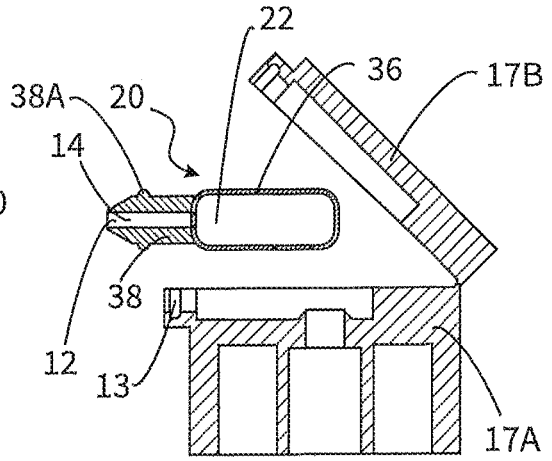
Figure 4B:
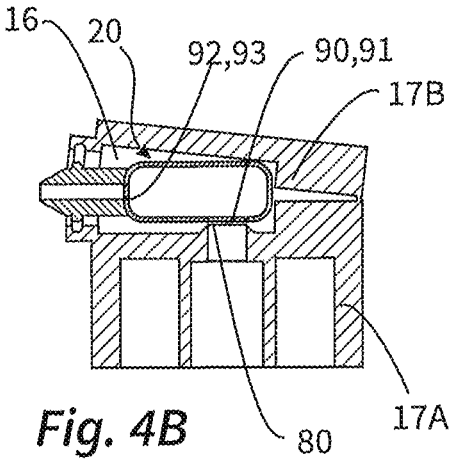
Figure 4C:
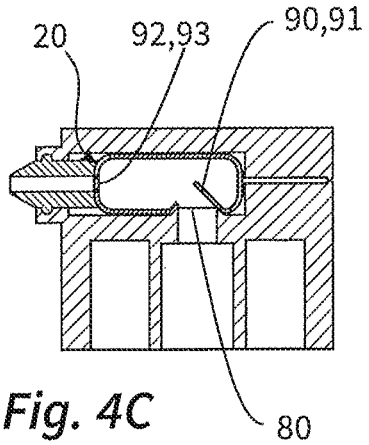

The exchange unit 20 in this exemplary embodiment can be readily seen from FIG. 4A. The exchange unit 20 has a mixing chamber 22 which is surrounded by a flexible film wall 36, wherein the membrane is fastened to a rigid portion 38 which is penetrated by part of the dispensing duct 14 and at whose end the dispensing opening 12 is provided. To put the liquid dispenser 100 as shown in FIG. 4 into operation, the receiving space 16 is made accessible by tilting up the closing element 17B, and the exchange unit 20 is inserted in such a way that an annular web 38A on the rigid portion 38 engages in a corresponding groove 13 on the two housing parts 17A, 17B. In this state, and corresponding to the illustration of FIG. 4B, the receiving space 16 is closed, with the result that the bag, surrounded by the film wall 36, having the mixing chamber 22 is pressed, in the region of an inlet-side closure 90 with closure surface 91, against an opening element 80 and is thereby opened, as illustrated in FIG. 4C. If the first actuation now occurs by pressing down the dispensing head 10, liquid flows out of the liquid reservoir 110 into the mixing chamber 22, here fills up a sufficiently high pressure and, through this pressure, destroys the closure surface 93 of the outlet-side closure 92, with the result that the dispensing duct 14 is then free of barriers and the liquid of the reservoir outlet 120, with the addition of the additional medium from the mixing chamber 22, is conveyed to the dispensing opening 12.

Figure 5A:
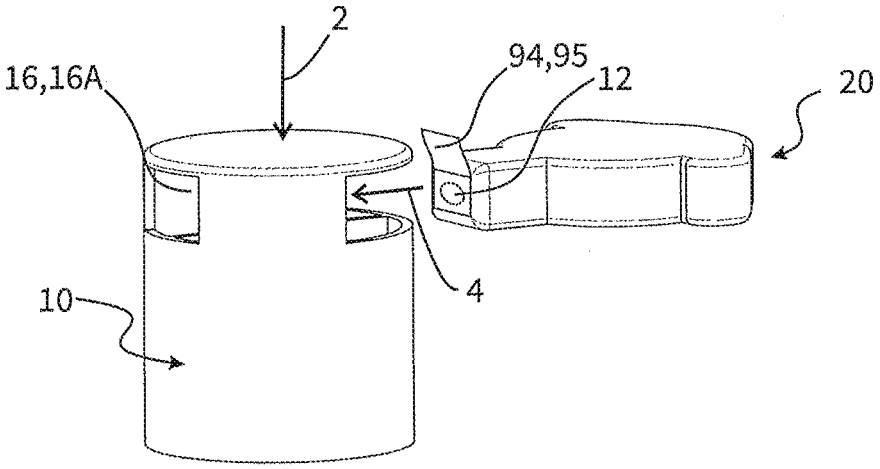
FIGS. 5A to 5C and 6A to 6D show a dispensing head for a fifth liquid dispenser according to the invention and the steps of putting it into operation.
Figure 5B:
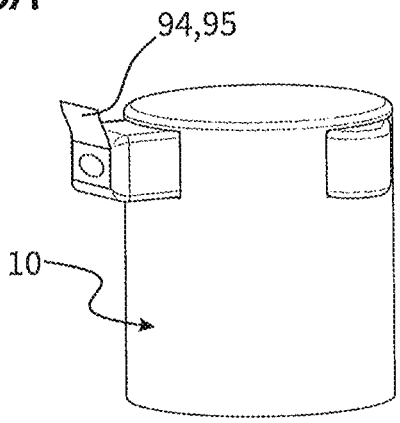
Figure 5C:
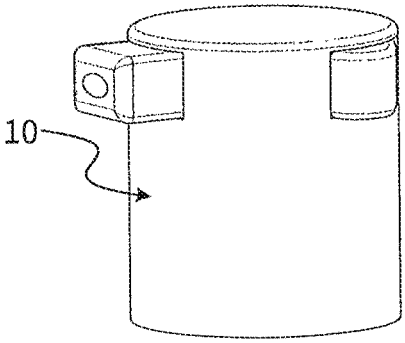
Figure 6A:
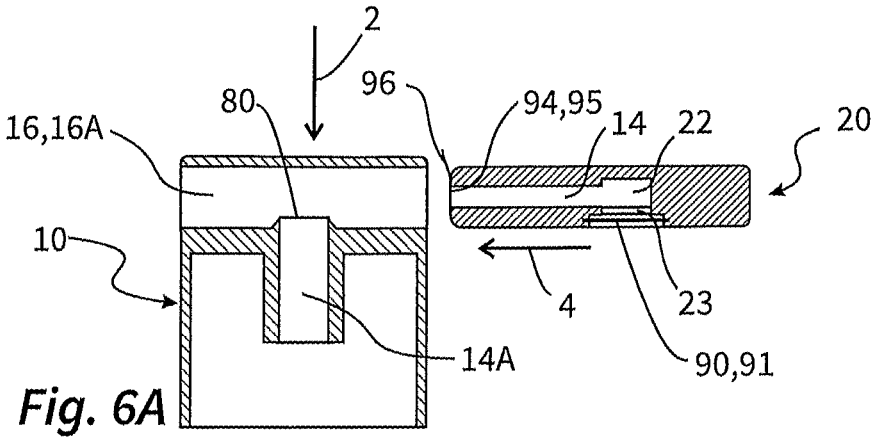
Figure 6B:
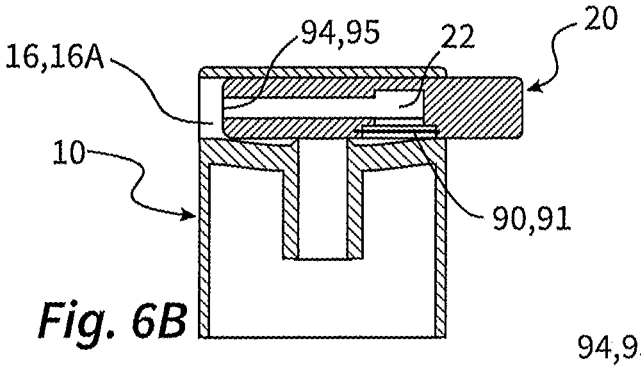
Figure 6C:
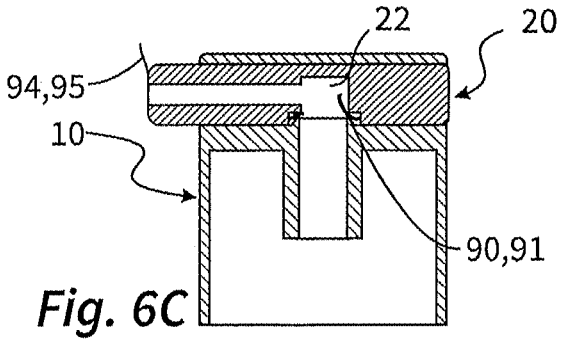
Figure 6D:
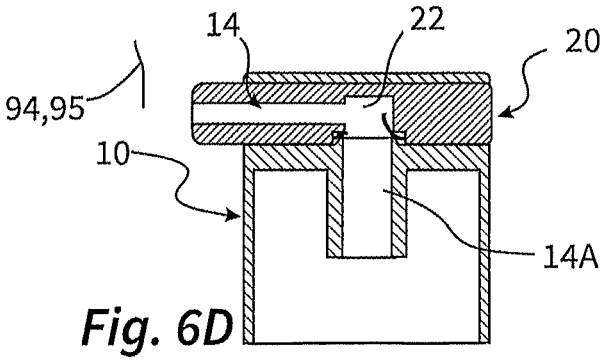

FIGS. 5A to 5C and 6A to 6D show a further variant of a dispensing head 10 of the type according to the invention. As illustrated in FIGS. 5A to 5C, there is provision here that the dispensing head 10, which, apart from the insertable exchange unit, is provided for reuse, has a receiving space 16 in the form of a receiving shaft 16A. Here, the exchange unit 20 is inserted transversely to the actuating direction 2 in the direction of the arrow 4 such that a dispensing opening 12 provided on the exchange unit 20 reaches as far as the opposite side during the insertion. The inserted state can be seen in FIG. 5B. At this time, an inlet-side closure in the mixing chamber 22 has already been opened, as will be explained below. All that therefore remains is to open the closure 94 by removing the closure surface formed as a peel-off film 95.

It can be seen from FIGS. 6A to 6D how the closure 90 is opened on the inlet 23 side. If in the manner illustrated in FIG. 6B, the exchange unit 20 is inserted into the receiving shaft 16A, it hereby deforms part of the housing 15 of the dispensing head 10. As soon as the exchange unit 20 has been inserted far enough, namely approximately up to the position of FIG. 6C, this deformation ceases again since now an opening element 80 on the housing 15 of the dispensing head 10 that has been temporarily deflected can spring back into its original position and thereby destroy the closure surface 91 of the closure 90 on the inlet 23 side of the mixing chamber 22. Finally, starting from the state of FIG. 6C, which corresponds to the state of FIG. 5B, the peel-off film 95 at an end 96 is manually removed such that the dispensing duct 14 is free and dispensing of the main liquid and the addition of the additional medium from the mixing chamber 22 can occur.

FIGS. 7A to 7D show a further embodiment, which can be regarded as a variant to the embodiment of FIG. 5A to 6D. In this embodiment, the dispensing opening 12 is not, as in the preceding variant, part of the exchange unit 20 but provided on the housing 15 of the dispensing head 10. Just as for opening the closure 90 on the inlet 23 side, on this housing of the dispensing head 10 the dispensing opening 12 is also assigned an opening element 80 which is intended to destroy a corresponding closure surface 91 on the outlet 24 side of the mixing chamber 22.

Figure 7A:
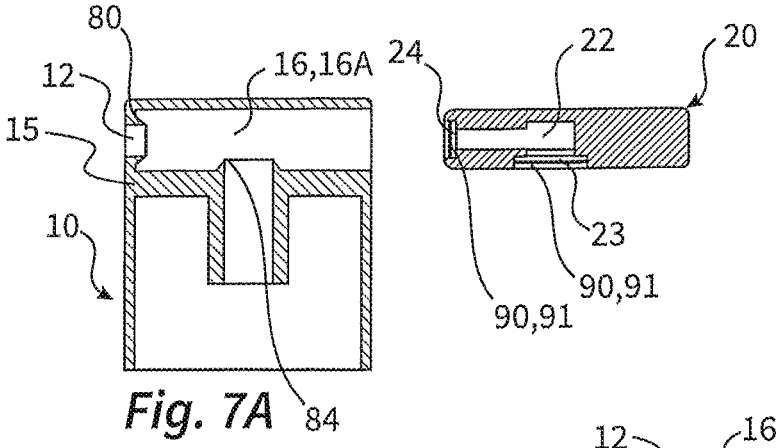
FIGS. 7A to 7D show a dispensing head for a sixth liquid dispenser according to the invention and the steps for putting it into operation.
Figure 7B:
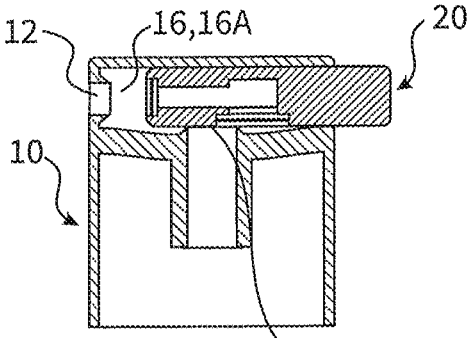
Figure 7C:
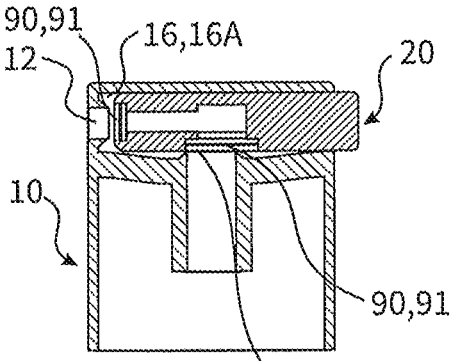
Figure 7D:
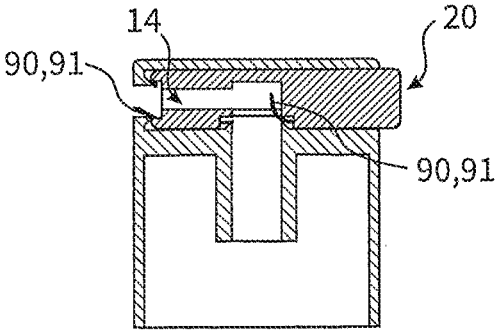

If the exchange unit 20 is inserted in the manner illustrated in FIG. 7B in the direction of the arrow 4, there is here again reached an intermediate state of FIG. 7C, starting from which the elastic deformation that has taken place until then can be relieved again. Here, however, the exchange unit 20 is pressed further to the left, with the result that the closure surfaces 91 on the inlet 23 side and the outlet 24 side of the mixing chamber 22 are destroyed approximately simultaneously by the respective opening elements 80. As a result, the state of FIG. 7D is achieved, in which the dispensing duct is free and it is possible for mixed liquid to be dispensed.

Figure 8A:
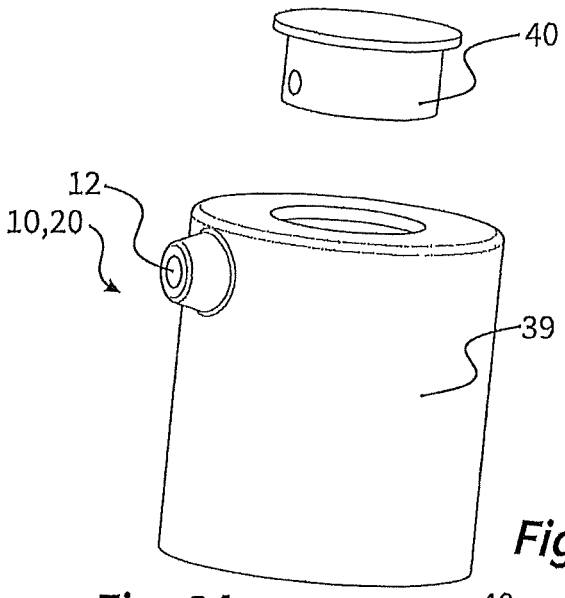
FIGS. 8A to 8C show a dispensing head for a seventh liquid dispenser according to the invention and the steps of putting it into operation.
Figure 8A:
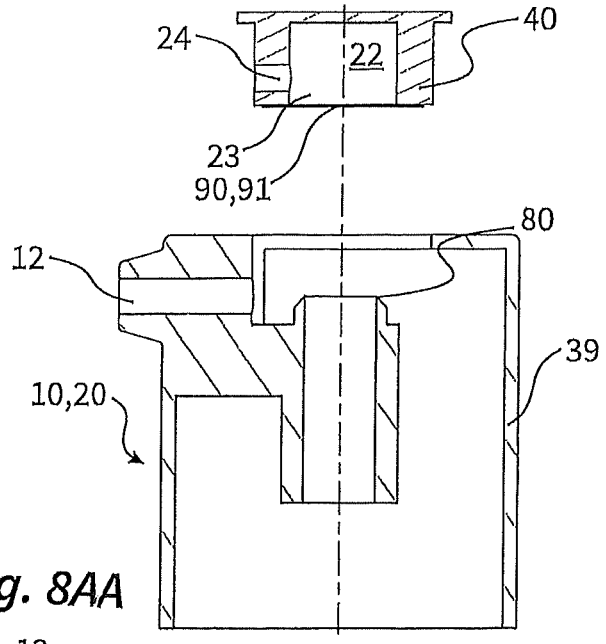
Figure 8B:
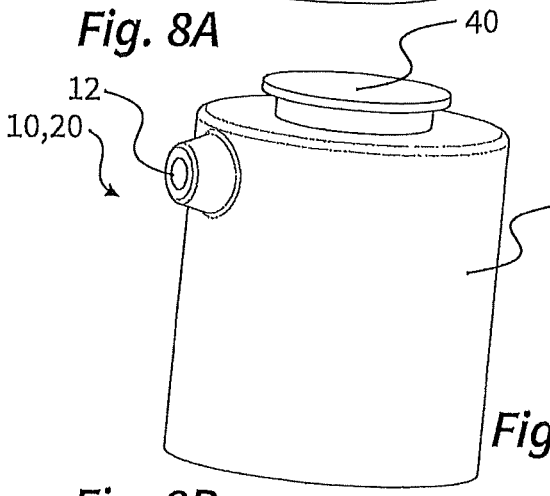
Figure 8B:
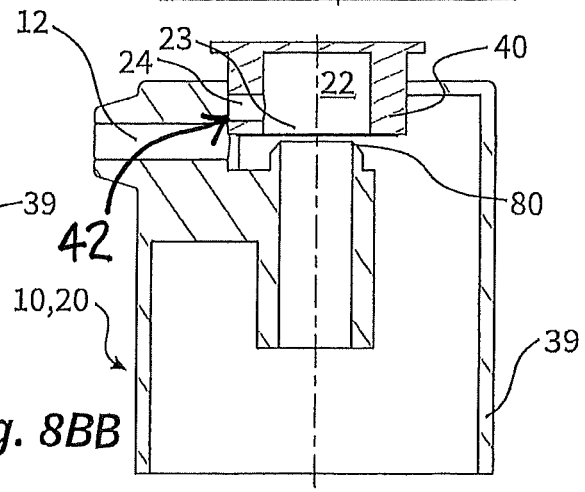
Figure 8C:
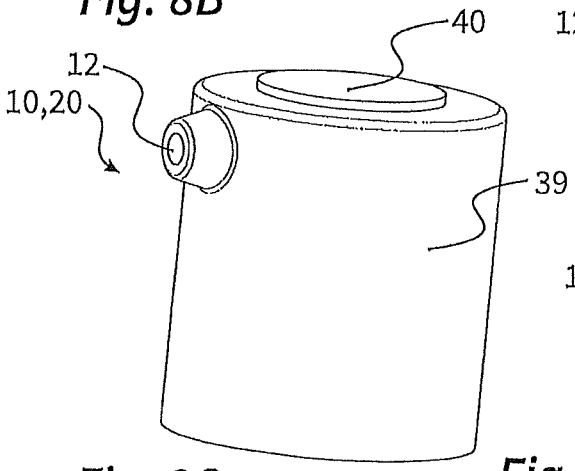
Figure 8C:
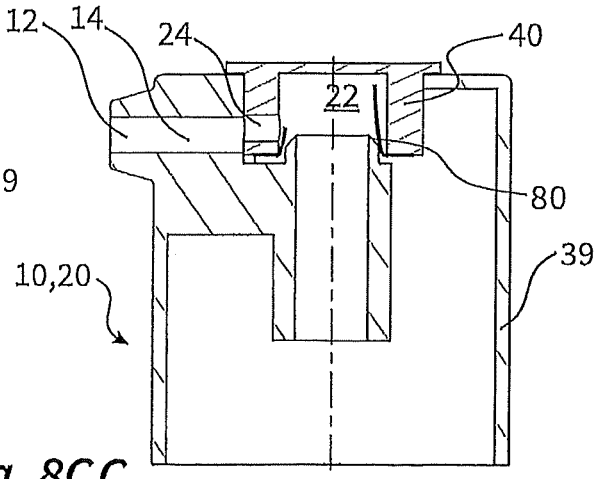

In the exemplary embodiment of FIGS. 8A to 8C there is merely shown a dispensing head 10 which simultaneously as a whole forms the exchange unit 20 and is thus provided for placing on a liquid reservoir corresponding for example to FIGS. 1 and 3. There is in this respect a certain degree of correspondence with the exemplary embodiment of FIGS. 1 to 1B, in which the entire dispensing head likewise constitutes the exchange unit.

The particular feature of the dispensing head 10 of FIGS. 8A to 8C and FIGS. 8AA, 8BB and 8CC is that it is composed of two components 39, 40 as a two-part exchange unit 20, with component 39 being the main component which is fastened on the outlet connector 122 of the liquid reservoir. The other component 40 of the exchange unit 20 has approximately the shape of an inverted bowl and is blocked off at its underside by a closure 90 having a closure surface 91. However, an outlet-side closure surface in this sense is not provided.

The state of FIGS. 8A and 8AA is an intermediate state during assembly, in which the component 40 has not yet been inserted into the main component 39. It is possible at this time for the mixing chamber 22 to be filled with the additional medium through the outlet 24. The state of FIGS. 8B and 8BB is then established, in which the outlet 24 is blocked off by inserting the component 40.

In this delivery and storage state of FIGS. 8B and 8BB, in which the mixing chamber 22 is filled with additional medium, the outlet 24 is closed by a sliding valve 42. This sliding valve 42 is formed by walls of the component 39 and a duct at the outlet 24. In the delivery and storage state of FIGS. 8B and 8BB, the mixing chamber 22 is thus isolated from the surroundings.

As soon as the exchange unit 20 is intended to be used, the dispensing head 10 forming the exchange unit 20 is placed on the outlet connector 122 of the liquid reservoir 110, and the component 40 is pressed deeper into the component 39. In this way, an opening element 80 on the component 39 comes into contact with the closure 90 with closure surface 91 on the inlet side of the mixing chamber 22 and destroys said surface, as can be seen from FIGS. 8C and 8CC. At the same time, a communicative connection between the outlet 24 and the dispensing opening 12 is established in the region of the sliding valve 42. After pressing down the component 40, the dispensing duct 14 is thus completely free and main liquid from the liquid reservoir 110 can be discharged from the mixing chamber 22 while the additional fluid is being admixed.

The invention claimed is:

1. A liquid dispenser comprising:

a liquid reservoir filled with a main liquid, wherein the liquid reservoir is designed as a pressure reservoir and has a switching valve by which the main liquid can be conveyed from the liquid reservoir to a reservoir outlet, or the liquid reservoir is designed as a pressureless liquid reservoir and has a conveying device by which the main liquid can be conveyed from the liquid reservoir to a reservoir outlet;

a dispensing head having a dispensing opening, a receiving space and a dispensing duct, the dispensing duct connecting the reservoir outlet to the dispensing opening and having a feed duct portion, wherein the dispensing head can be pressed down in an actuating direction in a direction of the liquid reservoir, with the switching valve or the conveying device being actuated as a result; and an interchangeable exchange unit which, in a functional state, forms the dispensing duct at least in certain portions, the exchange unit having a mixing chamber in which an additional medium is arranged, the mixing chamber having an inlet and an outlet separated therefrom, wherein the exchange unit is part of the dispensing duct such that the inlet is communicatively connected to the reservoir outlet and the outlet is communicatively connected to the dispensing opening, the exchange unit having closures at the inlet and at the outlet by which the mixing chamber is closed in a liquid-tight manner in a storage state;

wherein the receiving space of the dispensing head is designed to receive the exchange unit, the feed duct portion of the dispensing duct opens into the receiving space, and the exchange unit is designed such that, upon insertion into the receiving space, the exchange unit assumes a desired position in which a mouth of the feed duct portion comes into communicative connection with the inlet of the mixing chamber of the exchange unit.

2. The liquid dispenser as claimed in claim 1, wherein the receiving space has an opening element arranged and designed so as to be adapted to the exchange unit such that by introducing the exchange unit into the receiving space, or by closing a closing element which closes the receiving space, the closure at the inlet of the mixing chamber or the closure at the outlet of the mixing chamber is destructively opened.

3. The liquid dispenser as claimed in claim 1, wherein the receiving space is designed as a receiving shaft which is open at least on one side from an outer side of the dispensing head and the exchange unit can be inserted in an insertion direction into the receiving space.

4. The liquid dispenser as claimed in claim 3 wherein the insertion direction is oriented so as to be non-parallel to the actuating direction.

5. The liquid dispenser as claimed in claim 1, wherein the mixing chamber of the exchange unit is at least partially defined by film walls.

6. The liquid dispenser as claimed in claim 5, wherein the closure at the inlet of the mixing chamber is closed by a closure surface which is destroyed by an opening element of the receiving space.

7. The liquid dispenser as claimed in claim 5, wherein, the exchange unit has a rigid portion penetrated on an inlet side or an outlet side by the dispensing duct, and the receiving space and the exchange unit are adapted to one another such that the rigid portion can be fixed in a defined position at the receiving space in a form-fitting manner.

8. The liquid dispenser as claimed in claim 1, wherein the receiving space has an opening element for opening a closure surface at the inlet or at the outlet of the mixing chamber, and the receiving space and the exchange unit are designed in terms of their outer shape such that, upon insertion of the exchange unit into the receiving space, an elastic stress is generated in walls of the receiving space and/or of the exchange unit and is unloaded upon continued insertion such that the opening element is pressed against and destroys the closure surface as a result.

9. A set consisting of a liquid dispenser as claimed in claim 1 and at least one second structurally identical exchange unit.

10. A liquid dispenser comprising:

a liquid reservoir filled with a main liquid, wherein the liquid reservoir is designed as a pressure reservoir and has a switching valve by which the main liquid can be conveyed from the liquid reservoir to a reservoir outlet, or the liquid reservoir is designed as a pressureless liquid reservoir and has a conveying device by which the main liquid can be conveyed from the liquid reservoir to a reservoir outlet;

a dispensing head having a dispensing opening and a dispensing duct connecting the reservoir outlet to the dispensing opening, wherein the dispensing head can be pressed down in an actuating direction in a direction of the liquid reservoir, with the switching valve or the conveying device being actuated as a result; and an interchangeable exchange unit which, in a functional state, forms the dispensing duct at least in certain portions, the exchange unit having a mixing chamber in which an additional medium is arranged, the mixing chamber having an inlet and an outlet separated therefrom, wherein the exchange unit is part of the dispensing duct such that the inlet is communicatively connected to the reservoir outlet and the outlet is communicatively connected to the dispensing opening, the exchange unit having closures at the inlet and at the outlet by which the mixing chamber is closed in a liquid-tight manner in a storage state, and the exchange unit having a dispensing opening communicatively connected to the outlet of the mixing chamber;

wherein the dispensing head has an outer connection portion for coupling to the exchange unit, the outer connection portion being configured for use as the dispensing opening such that, even with the exchange unit not coupled to the outer connection portion of the dispensing head, it is to dispense the main liquid.

11. The liquid dispenser as claimed in claim 10, wherein the dispensing opening of the dispensing head is formed by the dispensing opening of the exchange unit when the exchange unit is coupled to the outer connection portion of the dispensing head.

12. The liquid dispenser as claimed in claim 10 wherein the mixing chamber is delimited, between the inlet and the outlet, by walls which, in an integral manner, are all part of a common component.

13. A liquid dispenser comprising as:

a liquid reservoir filled with a main liquid, wherein the liquid reservoir is designed as a pressure reservoir and has a switching valve by which the main liquid can be conveyed from the liquid reservoir to a reservoir outlet, or the liquid reservoir is designed as a pressureless liquid reservoir and has a conveying device by which the main liquid can be conveyed from the liquid reservoir to a reservoir outlet;

a dispensing head having a dispensing opening and a dispensing duct connecting the reservoir outlet to the dispensing opening, the dispensing head having a coupling connector on the dispensing duct and facing the liquid reservoir, wherein the dispensing head can be pressed down in an actuating direction in a direction of the liquid reservoir, with the switching valve or the conveying device being actuated as a result; and an interchangeable exchange unit which, in a functional state, forms the dispensing duct at least in certain portions, the exchange unit having a mixing chamber in which an additional medium is arranged, the mixing chamber having an inlet and an outlet separated therefrom, wherein the exchange unit is part of the dispensing duct such that the inlet is communicatively connected to the reservoir outlet and the outlet is communicatively connected to the dispensing opening, the exchange unit having closures at the inlet and at the outlet by which the mixing chamber is closed in a liquid-tight manner in a storage state, the exchange unit having a coupling connector for coupling to the coupling connector of the dispensing head and the coupling connector of the exchange unit is communicatively connected to the outlet of the mixing chamber, and the exchange unit having an inlet connector designed for communicative connection with the reservoir outlet.

14. A liquid dispenser comprising:

a liquid reservoir filled with a main liquid, wherein the liquid reservoir is designed as a pressure reservoir and has a switching valve by which the main liquid can be conveyed from the liquid reservoir to a reservoir outlet, or the liquid reservoir is designed as a pressureless liquid reservoir and has a conveying device by which the main liquid can be conveyed from the liquid reservoir to a reservoir outlet;

a dispensing head having a dispensing opening and a dispensing duct connecting the reservoir outlet to the dispensing opening, wherein the dispensing head can be pressed down in an actuating direction in a direction of the liquid reservoir, with the switching valve or the conveying device being actuated as a result; and an interchangeable exchange unit which, in a functional state, forms the dispensing duct at least in certain portions, the exchange unit having a mixing chamber in which an additional medium is arranged, the mixing chamber having an inlet and an outlet separated therefrom, wherein the exchange unit is part of the dispensing duct such that the inlet is communicatively connected to the reservoir outlet and the outlet is communicatively connected to the dispensing opening, the exchange unit having closures at the inlet and at the outlet by which the mixing chamber is closed in a liquid-tight manner in a storage state, the exchange unit having two sub-units which can be displaced relative to one another once for the purpose of activation, and the closure at the inlet and/or at the outlet of the mixing chamber is designed as a sliding valve, the sliding valve being opened by relative movement of the two sub-units in the course of the activation.

15. A liquid dispenser comprising:

a liquid reservoir filled with a main liquid, wherein the liquid reservoir is designed as a pressure reservoir and has a switching valve by which the main liquid can be conveyed from the liquid reservoir to a reservoir outlet, or the liquid reservoir is designed as a pressureless liquid reservoir and has a conveying device by which the main liquid can be conveyed from the liquid reservoir to a reservoir outlet;

a dispensing head having a dispensing opening and a dispensing duct connecting the reservoir outlet to the dispensing opening, wherein the dispensing head can be pressed down in an actuating direction in a direction of the liquid reservoir, with the switching valve or the conveying device being actuated as a result;

an interchangeable exchange unit which, in a functional state, forms the dispensing duct at least in certain portions, the exchange unit having a mixing chamber in which an additional medium is arranged, the mixing chamber having an inlet and an outlet separated therefrom, wherein the exchange unit is part of the dispensing duct such that the inlet is communicatively connected to the reservoir outlet and the outlet is communicatively connected to the dispensing opening, the exchange unit having closures at the inlet and at the outlet by which the mixing chamber is closed in a liquid-tight manner in a storage state, and the closure at the inlet and/or at the outlet of the mixing chamber is provided with a peel-off film.

16. A liquid dispenser comprising:

a liquid reservoir filled with a main liquid, wherein the liquid reservoir is designed as a pressure reservoir and has a switching valve by which the main liquid can be conveyed from the liquid reservoir to a reservoir outlet, or the liquid reservoir is designed as a pressureless liquid reservoir and has a conveying device by which the main liquid can be conveyed from the liquid reservoir to a reservoir outlet;

a dispensing head having a dispensing opening and a dispensing duct connecting the reservoir outlet to the dispensing opening, wherein the dispensing head can be pressed down in an actuating direction in a direction of the liquid reservoir, with the switching valve or the conveying device being actuated as a result; and an interchangeable exchange unit which, in a functional state, forms the dispensing duct at least in certain portions, the exchange unit having a mixing chamber in which an additional medium is arranged, the mixing chamber having an inlet and an outlet separated therefrom, wherein the exchange unit is part of the dispensing duct such that the inlet is communicatively connected to the reservoir outlet and the outlet is communicatively connected to the dispensing opening, the exchange unit having closures at the inlet and at the outlet by which the mixing chamber is closed in a liquid-tight manner in a storage state, and the closure at the inlet and/or at the outlet being closed by a closure surface, a destructive opening of the closure surface requiring an opening pressure less than a pressure which can be generated by the pressure reservoir or by the conveying device.

* * * * *